US005509150A

United States Patent [19]

Bergmann et al.

[11] Patent Number: 5,509,150

[45] Date of Patent: Apr. 23, 1996

[54] DRAINAGE FIXTURE

[75] Inventors: Konrad Bergmann, Wittlich; Klaus J. Läller, Meckenheim-Merl, both of Germany

[73] Assignee: Ideal-Standard GmbH, Bonn, Germany

[21] Appl. No.: 300,595

[22] Filed: Sep. 2, 1994

Related U.S. Application Data

[63] Continuation of Ser. No. 30,327, Mar. 12, 1993, abandoned.

[30] Foreign Application Priority Data

Sep. 14, 1990 [DE] Germany ..... 40 29 164.2

[51] Int. Cl.[6] ..... E03C 1/23

[52] U.S. Cl. ..... 4/691; 4/689

[58] Field of Search ..... 4/287, 293, 295, 4/682, 683, 684, 685, 688, 689, 690, 691, 692, 693

[56] References Cited

U.S. PATENT DOCUMENTS

| | | | |
|---|---|---|---|
| 1,048,823 | 12/1912 | Graham | 4/684 X |
| 1,547,764 | 7/1925 | Kuehl | 4/685 |
| 1,573,820 | 2/1926 | Gade | 4/685 |
| 2,989,758 | 6/1961 | Turek et al. | 4/689 |
| 3,314,083 | 4/1967 | Minella | 4/692 |

FOREIGN PATENT DOCUMENTS

| | | | |
|---|---|---|---|
| 0375988 | 9/1984 | Austria | 4/689 |
| 3909651 | 9/1990 | Germany . | |
| 0002135 | 3/1890 | Sweden | 4/682 |

*Primary Examiner*—Robert M. Fetsuga
*Attorney, Agent, or Firm*—Robert W. Becker & Associates

[57] ABSTRACT

A drainage fixture for a sanitary device, such as a sink, lavatory, or bathtub having a drainage socket with a drain hole includes a drainage funnel and a stationary disk inserted into the drain hole of the sanitary device. A plunger, including a plunger head and a guide element, for closing the drain hole is positioned under the stationary disk so as to be movable between a closed and an open position. The drainage funnel has an upper rim portion forming a sealing collar for the plunger head in the closed position. The upper rim portion is recessed in the drain hole so as to provide space for a longitudinal movement of the plunger head between the closed and the open positions. The stationary disk is made of ceramic material of a color adapted to the color of the ceramic material of the sanitary device and has a diameter that is smaller than the diameter of the drain hole and at least as great as the greatest diameter of the upper rim portion of the drainage funnel so that an annular gap is formed between the stationary disk and the rim of the drain hole.

9 Claims, 5 Drawing Sheets

DRAINAGE FIXTURE

This application is a continuation of application Ser. No. 08/030,327 filed Mar. 12, 1993, abandoned.

BACKGROUND OF THE INVENTION

The invention relates to a drainage fixture for sanitary devices, such as sinks, lavatories, bathtubs, having a drainage funnel held within a drain hole in which a plunger as a closure member, comprised of a guide element and a plunger head, is longitudinally slidable via a plunger rod for the drain hole, whereby the upper rim portion of the drainage funnel forms a sealing collar for the plunger head in its closed position and this upper rim portion of the drainage funnel is deeply inserted with its seating surface into the inner walls of the drainage funnel of the sanitary device.

A drainage fixture of the aforementioned kind is known from German patent 39 09 651. Here, the plunger head is arranged such that its upper surface in the open position of the plunger forms a plane with the upper rim of the drain hole whereby its diameter is at least as great as the greatest diameter of the upper rim portion of the drainage funnel in order to visually cover the upper rim portion of the drainage funnel positioned within the interior of the drain hole.

The known drainage fixture has the disadvantage that the plunger head in its color and design must completely be matched with the corresponding sanitary device so that for different sanitary devices the respective corresponding drainage fixtures must be provided with differently manufactured plunger heads. Furthermore, the plunger head of the aforementioned kind is more expensive to manufacture than plunger heads of other conventional drainage fixtures which are not matched in color and design to the sanitary devices.

Another drainage fixture is known from French document A-1 543 952. The drainage device has a drainage funnel having a circumferential horizontally extending rim portion positioned in a corresponding recess of the inner wall of the drain hole and providing a support for a disk that completely covers the drain hole. This disk has small holes distributed over its surface area for providing a drainage passage for water and also a means for retaining solid particles contained in the water. Below the disk, a conventional plunger with a plunger head cooperating with the drainage funnel for closing the drain is movable between a closed and an open position.

The known drainage fixture has the disadvantage that through the stationary disk with holes the plunger is visible so that this fixture does not conform to the aesthetic requirements especially for bathroom fixtures.

A further drainage fixture with a stationary disk is known from Austrian document B-375 988. The actual drainage fixture is arranged outside of the sanitary device such that into the drain hole of the sanitary device a drainage sleeve with an upper rim portion is inserted into which a stationary disk is inserted whereby an annular gap for water drainage is formed between the drainage hole and the disk. However, the disk does not cover the drainage sleeve, and a visually unpleasant effect results.

It is therefore an object of the invention to provide a drainage fixture for sanitary devices which, while maintaining the overall visual impression of the aforementioned drainage fixture, is more economical to manufacture.

SUMMARY OF THE INVENTION

The drainage fixture for a sanitary device having a drainage socket with a drain hole according to the present invention is primarily characterized by:

a drainage funnel;

a stationary disk inserted into the drain hole;

a plunger, comprised of a plunger head and a guide element for closing the drain hole, positioned under the stationary disk so as to be movable between a closed and an open position;

the drainage funnel having an upper rim portion forming a sealing collar for the plunger head in the closed position, with the upper rim portion recessed in the drain hole so as to provide space for a longitudinal movement of the plunger head between the closed and the open positions;

the stationary disk comprised of a ceramic material of a color matching the color of the ceramic material of the sanitary device; and the stationary disk having a diameter that is smaller than a diameter of the drain hole and at least as great as the greatest diameter of the upper rim portion of the drainage funnel, thereby forming an annular gap between the stationary disk and a rim of the drain hole.

The gist of the present invention is to provide a sealing collar for the plunger head in its closed position with the upper rim portion of the drainage funnel, whereby the upper rim portion with its seating surface is deeply inserted into the inner wall of the drain hole (drainage socket) to thereby provide play for longitudinal movement of the plunger head. Furthermore, the stationary disk is made of a ceramic part that matches in its coloration the ceramic material. The sanitary device is made of and has a diameter that is smaller than the diameter of the drain hole, but is at least as great as the greatest diameter of the upper rim portion of the drainage funnel so that the annular gap formed between the rim of the drain hole and the disk provides drainage and flow characteristics corresponding to the conventional requirements of drainage fixtures.

The stationary disk has supports distributed over its periphery and is supported with these supports on a downwardly narrowing inner wall of the drainage socket. The inner wall of the drainage socket has recesses for receiving the supports. Preferably, the inner wall has means for receiving the supports, this means shaped to provide a form-fitting connection.

In another embodiment of the present invention, the stationary disk has supports distributed over its periphery and is supported with these supports on the upper rim portion of the drainage funnel, and the inner wall has means for receiving the supports, the means shaped to provide a form-fitting connection.

In a further embodiment of the present invention, the underside of the disk has a guide rod and the plunger has a channel for receiving the guide rod.

The stationary disk is preferably made of the same material as the sanitary device. The upper surface of the stationary disk is shaped to conform to the contour of the sanitary device in the area of the drain hole. Preferably, the disk has a convex upper surface, and a top portion of the convex upper surface is in the same plane as the rim of the drain hole. The stationary disk can also have a concave upper surface or, as an alternative, a planar upper surface and a planar underside parallel to the upper surface.

The basic principle of the invention is that a stationary disk having a diameter that is smaller than the diameter of the drain hole is inserted into the drain hole, that the drainage funnel corresponds to a standardized drainage fixture and is inserted into the inner walls of the drain hole at such a distance to the disk that the plunger head is movable between a closed position and an open position below the stationary disk. The diameter of the disk is adapted to the diameter of the drain hole such that an annular gap therebetween remains constantly open and corresponds to the flow requirements of conventional drainage fixtures. The invention has essentially the advantage that the plunger head which is covered by the stationary disk fixed within the drain hole can be made of any suitable material and have a simple design because it is not visible at any time. The stationary disk can be easily manufactured with respect to material, design and coloration in correspondence to the sanitary device, whereby a disk for insertion into the drain hole of the sanitary device must be selected and added to the standardized drainage fixture in order to match the respective sanitary device. In this context it is especially expedient when the diameter of the disk is at least as great as the greatest diameter of the upper rim portion of the drainage funnel of the drainage fixture because then not only the plunger head but also the upper rim portion serving as a seat for the drainage funnel is completely covered.

In order to provide a secure lodgement of the stationary disk within the drain hole for it to remain in its position especially during cleaning, respectively, wiping of the sanitary device, it is suggested according to embodiments of the invention to provide respective form-fitting or guiding designs in order to ensure the fast lodgement of the disk within the drain hole. According to one embodiment of the invention, the disk is provided at its periphery with supports and is inserted into the drain hole whereby the supports rest at the narrowing inner walls of the drain hole within the sanitary device. It is especially advantageous when the inwardly displaced supports rest at the upper rim of the drainage funnel whereby at this location it is possible to take advantage of the transition between the drainage fixture and the sanitary device for providing the corresponding form-fitting design. Such a design is advantageous because the supports are arranged below the disk and are therefore invisible.

Alternatively, it is also possible to arrange depressions within the inner wall of the drain hole which are engaged by the slantedly oriented supports connected to the disk. In this case, the supports are practically invisible in the annular gap surrounding the disk; in any case, it is possible by a respective coloration to substantially prevent any disruptive visual impression.

A further possibility of securing the disk against displacement is the provision of a guide rod at the underside of the disk which engages a channel provided within the plunger. A play is provided allowing for the plunger head to be displaced relative to the disk during opening and closing movements; but, on the other hand, a securing against displacement of the disk within the drain hole is provided. This measure can be used alone for securing the disk, or in combination with additional supportive measures via respective supports and/or projections.

In the context of the invention the use of a standardized drainage fixture refers to the dimensions and the respective arrangement of the functional parts. With respect to the fixed arrangement of the inventive disk within the drain hole it is also possible to realize constructive adaptations which lie outside of the functional range of the drainage fixture.

It is furthermore advantageous to produce the disk from the same material as the sanitary device and to choose the same coloration. It is especially advantageous to adapt the upper surface of the disk to the contour of the sanitary device within the area of the drain hole whereby for this purpose different designs, such as a concave upper surface of the disk or a disk embodiment with parallel planes, are expedient.

BRIEF DESCRIPTION OF THE DRAWINGS

In the drawings embodiments of the invention are represented which will be explained in the following. It is shown in.

DESCRIPTION OF PREFERRED EMBODIMENTS

Figure 1A:
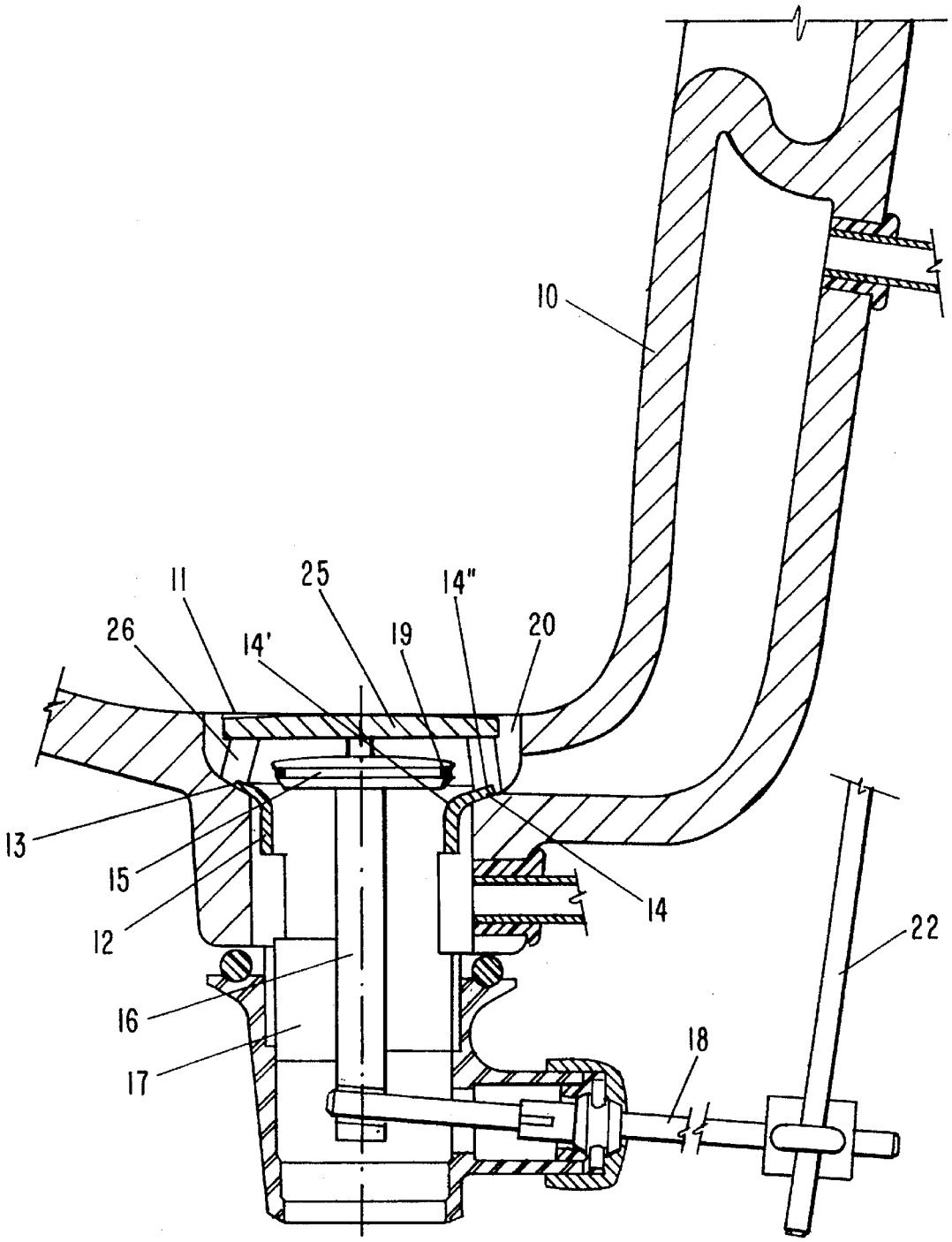
FIG. 1*a* and 1*b* a portion of a lavatory in cross-section with the drainage fixture in its open position, FIG. 1*a* a planar disk surface, FIG. 1*b* a concave disk surface, FIG. 2 the device of FIG. 1 with the plunger in the closed position, FIG. 3 a further embodiment of the drainage fixture in a representation according to FIG. 2, FIG. 4 a further embodiment in a representation according to FIG. 2.

As an example for the arrangement of an invention drainage fixture a lavatory 10 made of sanitary ceramic is shown. It has a drain hole 11 in which a drainage funnel 12 with its seating surface 13 is inserted in a water-tight manner. The inner upper rim portion 14 of the drainage funnel 12 narrows conically and forms a sealing collar 14 for the plunger head 15 of a plunger 16 which is longitudinally movable by guide elements 17 in the drainage funnel 12 and connected to a plunger rod 18. The plunger rod 18 effects the longitudinal movement of the guide elements 17 between the open position of the plunger head 15 and its closed position with the aid of a pull rod 22. An annular seal 19 provided at the underside of the plunger head 15 ensures in the closed position of the plunger head 15 a tight contact of the plunger head 15 on the sealing collar 14' of the drainage funnel 12.

In the plane of the drain hole 11 a stationary disk 25 is arranged which is inserted with three supports 26 provided at its periphery in the drain hole 11 such that the supports 26 rest on (are seated on) a seat 14" provided at the upper portion 14 of the drainage funnel 12. The diameter of the disk 25 is selected with respect to the diameter of the drain hole 11 such that a permanently open annular gap 20 results through which the water can drain from the sanitary device.

Figure 1B:
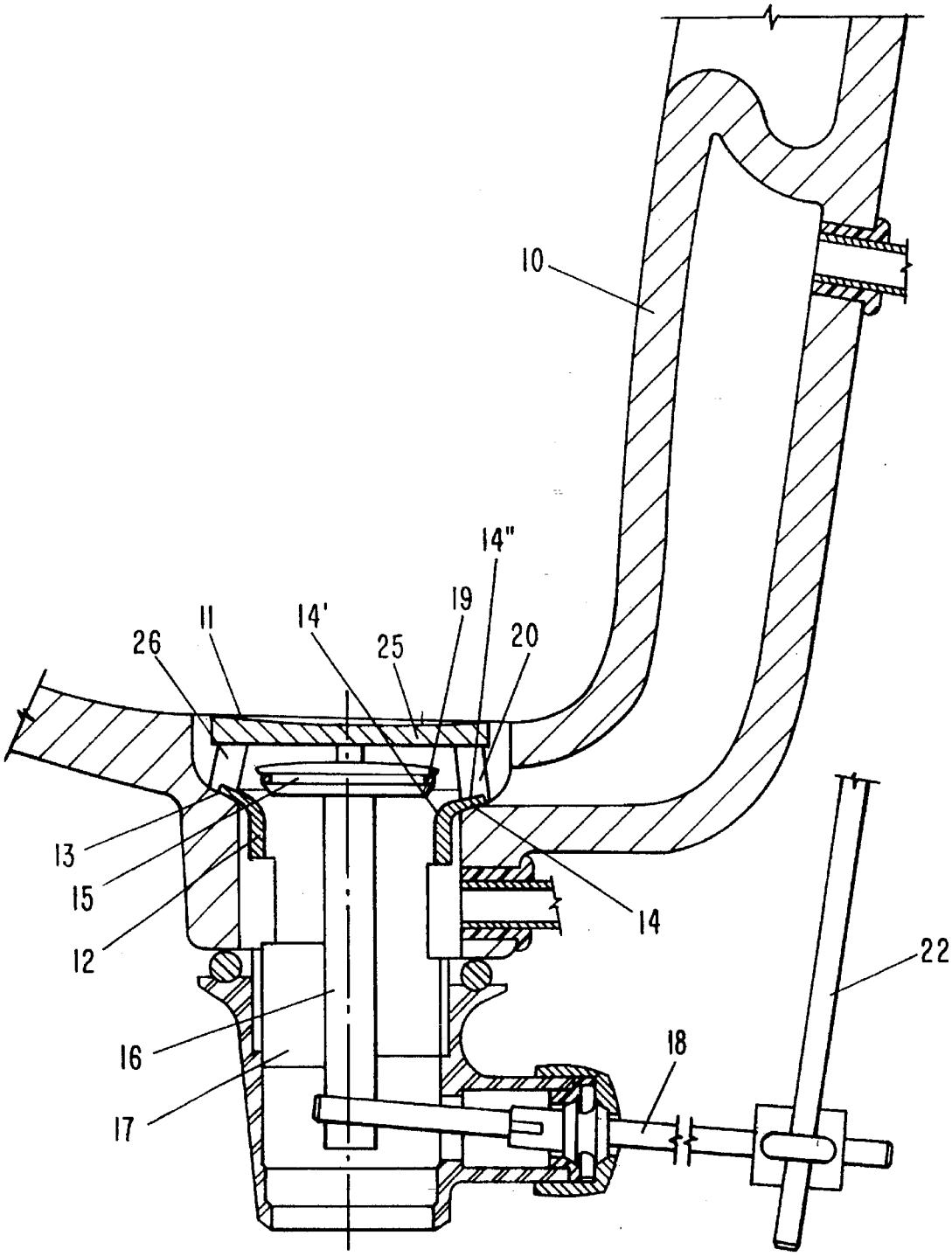
Figure 2:
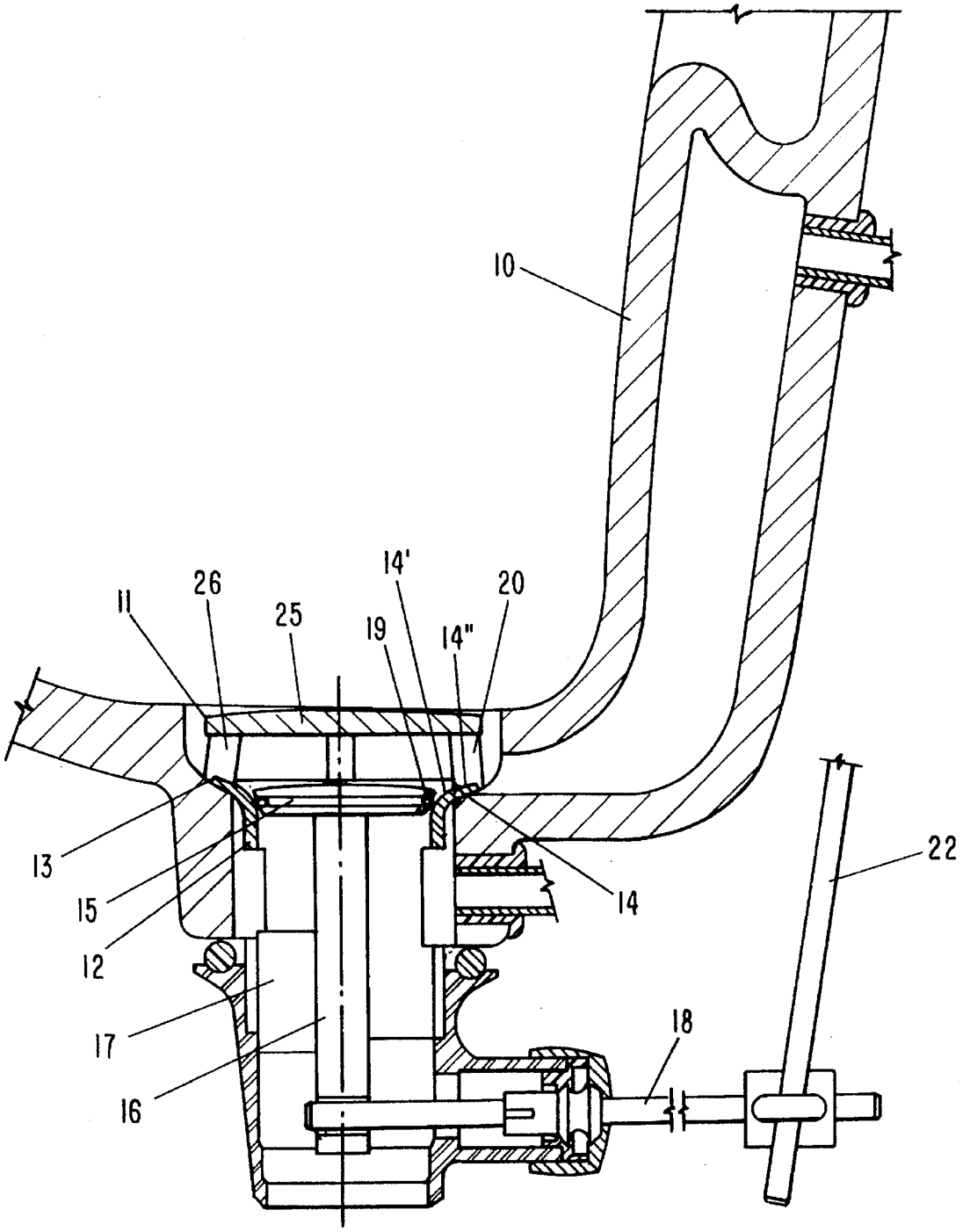

It is obvious from a comparison of the FIGS. 1 and 2 that the drainage funnel 12 is inserted to such an extent into the inner walls of the device 10 that the plunger head 15 is movable between a closed and an open position without changing the position of the disk 25 in the plane of the drain hole 11. At the same time, the disk 25 covers not only the plunger head 15, but also the upper rim portion 14 of the drainage funnel 12. Since the supports 26 rest on (are seated on) the seat 14" of the upper rim portion 14 of the drainage funnel 12, they are also covered by the disk 25.

As is further shown, the supports, respectively, the upper rim portion of the drainage funnel are provided with corresponding form-fitting connections in order to fix the disk 25 in the drain hole. For this purpose, it is possible to provide the upper rim portion 14 of the drainage funnel 12 with openings into which the disk 25 with its supports 26 can be inserted in a snap-on manner.

Figure 3:
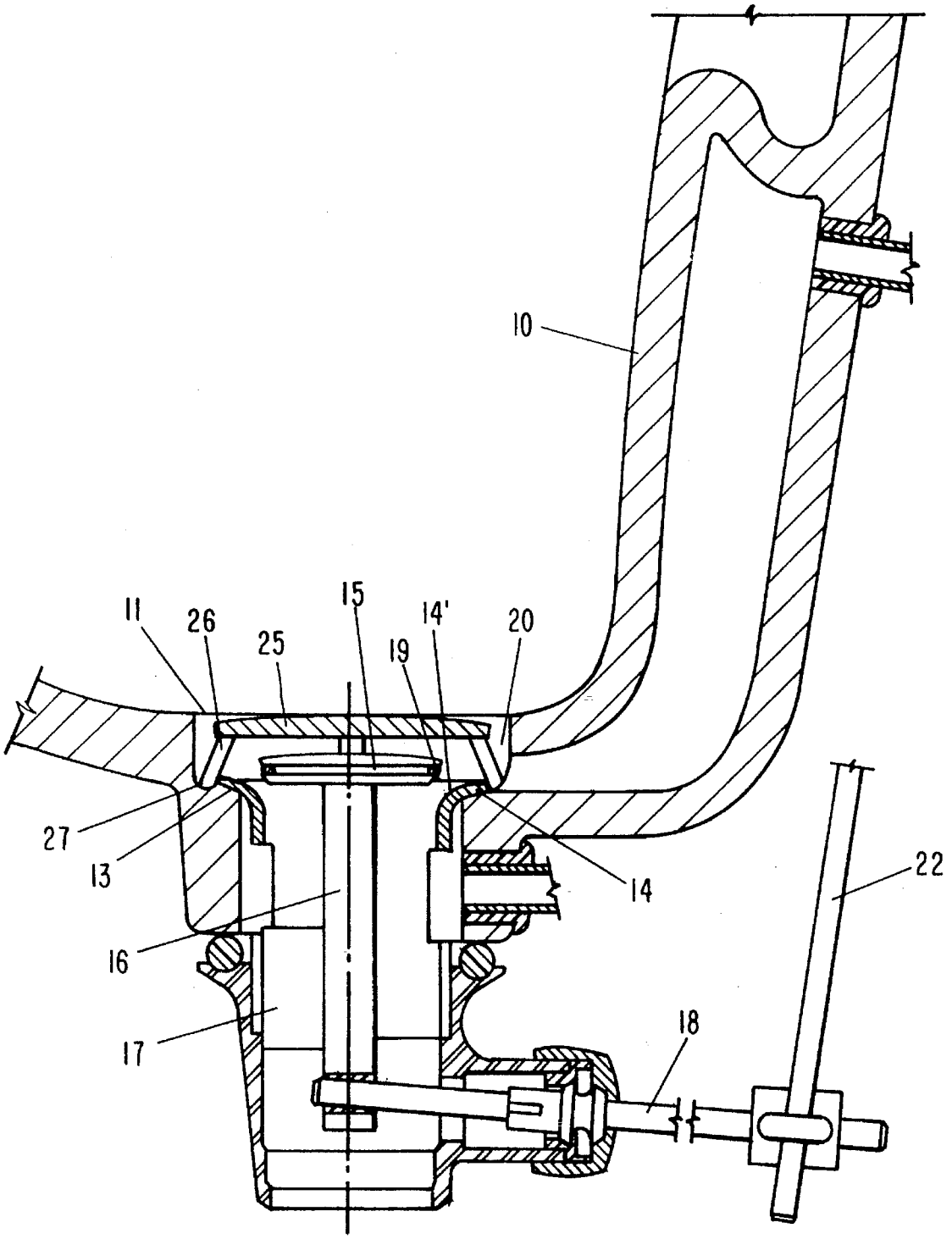

As can be seen in FIG. 3, it is alternatively possible to provide the inner wall of the drain hole with depressions 27 which are then engaged by the supports which are slanted relative to the plane of the disk 25. As long as the supports have the same coloration as the disk 25 no disturbing visual effect will result. This embodiment, however, has the advantage that the disk is fixedly connected with the drain hole and rests at the sanitary device.

Figure 4:
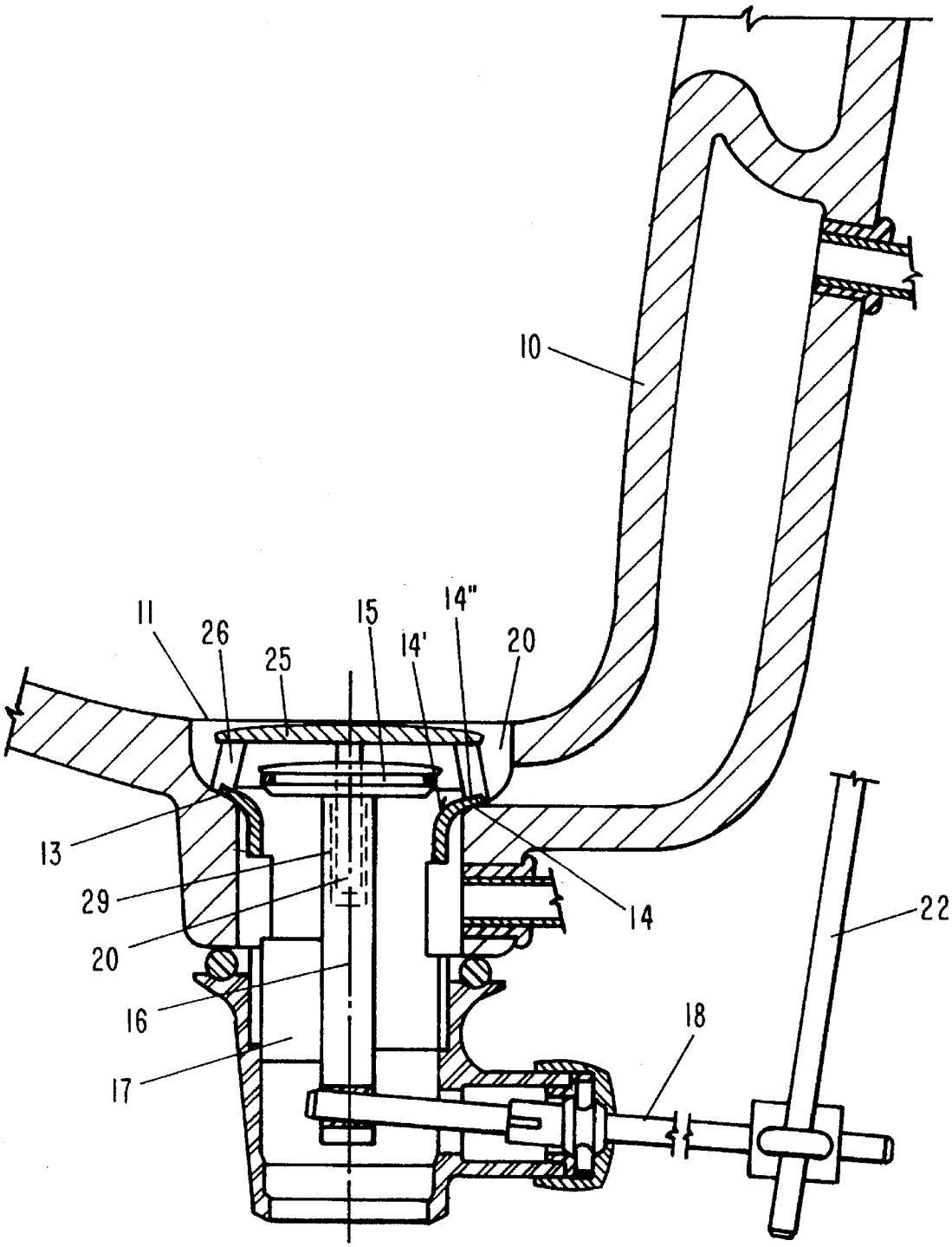

FIG. 4 shows a further embodiment of the invention with respect to the attachment of the disk 25 wherein at the underside a rod 28 is provided which engages a corresponding channel 29 within the plunger 16. The channel 29 as well as the rod 28 are dimensioned such that a smooth guiding of the plunger head 15 relative to the stationary disk 25 results. On the other hand, the disk 25 is secured relative to the plunger head against displacement. This measure can be used alone or in combination with further supportive means.

The features of the inventive device disclosed in the above description, the claims, the abstract and the drawing can be used individual or in any desirable combination for the realization of the invention and its various embodiments.

The present invention is, of course, in no way restricted to the specific disclosure of the specification and drawings, but also encompasses any modifications within the scope of the appended claims.

We claim:

1. A drainage fixture for a sanitary device having a drainage socket with a drain hole, said fixture comprising:

a drainage funnel;

a stationary disk for insertion into the drain hole of the drainage socket, said stationary disk having supports distributed over a periphery of said stationary disk;

a plunger, comprised of a plunger head and a guide element, for closing the drain hole, said plunger positioned under said stationary disk so as to be movable between a closed position and an open position, wherein an underside of said disk has a guide rod and wherein said plunger has a channel for receiving said guide rod;

said drainage funnel having an upper rim portion comprising a sealing collar for said plunger head in the closed position, said upper rim portion being positioned in a recessed manner in the drain hole;

said drainage funnel further comprising a seat arranged substantially radially outwardly of said sealing collar, wherein said supports of said stationary disk are seated on said seat such that said supports of said stationary disk provide space for a longitudinal movement of said plunger head between said closed and said open positions;

said stationary disk comprised of a ceramic material of a color matching a color of a ceramic material of the sanitary device;

said stationary disk having a diameter that is smaller than a diameter of the drain hole and at least as great as a greatest diameter of said upper rim portion of said drainage funnel, thereby forming an annular gap between said stationary disk and a rim of the drain hole; and said stationary disk having a convex upper surface, with a top portion of said convex upper surface of said stationary disk positioned in a same plane as said rim of said drain hole.

2. A drainage fixture according to claim 1, wherein said seat of said upper rim portion is shaped to provide a form-fitting connection between said supports and said seat.

3. A drainage fixture according to claim 1, wherein said disk is made of the same material as the sanitary device.

4. A drainage fixture for a sanitary device having a drainage socket with a drain hole, said fixture comprising:

a drainage funnel;

a stationary disk for insertion into the drain hole of the drainage socket, said stationary disk having supports distributed over a periphery of said stationary disk;

a plunger, comprised of a plunger head and a guide element, for closing the drain hole, said plunger positioned under said stationary disk so as to be movable between a closed position and an open position, wherein an underside of said disk has a guide rod and wherein said plunger has a channel for receiving said guide rod;

said drainage funnel having an upper rim portion comprising a sealing collar for said plunger head in the closed position, said upper rim portion being positioned in a recessed manner in the drain hole;

said drainage funnel further comprising a seat arranged substantially radially outwardly of said sealing collar, wherein said supports of said stationary disk are seated on said seat such that said supports of said stationary disk provide space for a longitudinal movement of said plunger head between said closed and said open positions;

said stationary disk comprised of a ceramic material of a color matching a color of a ceramic material of the sanitary device;

said stationary disk having a diameter that is smaller than a diameter of the drain hole and at least as great as a greatest diameter of said upper rim portion of said drainage funnel, thereby forming an annular gap between said stationary disk and a rim of the drain hole; and said stationary disk having a concave upper surface.

5. A drainage fixture according to claim 4, wherein said seat of said upper rim portion is shaped to provide a form-fitting connection between said supports and said seat.

6. A drainage fixture according to claim 4, wherein said stationary disk is made of the same material as the sanitary device.

7. A drainage fixture for a sanitary device having a drainage socket with a drain hole, said fixture comprising:

a drainage funnel;

a stationary disk for insertion into the drain hole of the drainage socket, said stationary disk having supports distributed over a periphery of said stationary disk;

a plunger, comprised of a plunger head and a guide element, for closing the drain hole, said plunger positioned under said stationary disk so as to be movable between a closed position and an open position, wherein an underside of said disk has a guide rod and wherein said plunger has a channel for receiving said guide rod;

said drainage funnel having an upper rim portion comprising a sealing collar for said plunger head in the closed position, said upper rim portion being positioned in a recessed manner in the drain hole;

said drainage funnel further comprising a seat arranged substantially radially outwardly of said sealing collar, wherein said supports of said stationary disk are seated on said seat such that said supports of said stationary disk provide space for a longitudinal movement of said plunger head between said closed and said open positions;

said stationary disk comprised of a ceramic material of a color matching a color of a ceramic material of the sanitary device;

said stationary disk having a diameter that is smaller than a diameter of the drain hole and at least as great as a greatest diameter of said upper rim portion of said drainage funnel, thereby forming an annular gap between said stationary disk and a rim of the drain hole; and said stationary disk having a planar upper surface and a planar underside parallel to said upper surface.

8. A drainage fixture according to claim 7, wherein said seat of said upper rim portion is shaped to provide a form-fitting connection between said supports and said seat.

9. A drainage fixture according to claim 7, wherein said stationary disk is made of the same material as the sanitary device.

* * * * *